US007395141B1

(12) United States Patent
Seck et al.

(10) Patent No.: US 7,395,141 B1
(45) Date of Patent: Jul. 1, 2008

(54) DISTRIBUTED TRAIN CONTROL

(75) Inventors: Daryl William Seck, Overland Park, KS (US); Joseph Forrest Noffsinger, Lees Summit, MO (US); Robert James Foy, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/854,425

(22) Filed: Sep. 12, 2007

(51) Int. Cl.
*G06F 19/00* (2006.01)

(52) U.S. Cl. ..... 701/19; 246/87 C

(58) Field of Classification Search ..... 701/1, 701/19, 36; 246/167 R, 182 R, 186, 187 R; 105/26.05, 27
See application file for complete search history.

(56) References Cited

U.S. PATENT DOCUMENTS 4,553,723 A 11/1985 Nichols et al.
4,582,280 A 4/1986 Nichols et al.
5,340,062 A 8/1994 Heggestad
5,452,870 A 9/1995 Heggestad
5,533,695 A 7/1996 Heggestad et al.
6,400,281 B1 6/2002 Darby, Jr. et al.
6,862,502 B2 * 3/2005 Peltz et al. ..... 701/19
7,302,895 B2 * 12/2007 Kumar et al. ..... 105/26.05

* cited by examiner

*Primary Examiner*—Richard M. Camby
(74) *Attorney, Agent, or Firm*—John A. Kramer; Trego, Hines & Ladenheim, PLLC

(57) ABSTRACT

A method of distributed control of train throttle and braking includes transmitting an instruction to a remote power unit to apply at least one acceleration to the train at a future time; receiving the instruction; transmitting a confirmation that the remote power unit is armed to execute the instruction to a lead power unit; and computing a profile describing at least one acceleration to be applied to the train as it travels over a predetermined route. The computation is determined at least in part on whether or not the confirmation has been received by the lead power unit. The instructions may be contained in a profile which optimizes fuel consumption, emissions, and/or trip time. The accelerations may be carried out by direct control or by prompting an operator. In another aspect, the confirmed instructions may be used to ensure braking in accordance with a predetermined braking curve.

45 Claims, 5 Drawing Sheets

DISTRIBUTED TRAIN CONTROL

BACKGROUND OF THE INVENTION

This invention relates generally to trains and other rail vehicles and more particularly to systems and methods for distributed control of trains.

Train cars are commonly provided with a type of air brake system which functions to apply brakes on the car upon a pressure drop in a "brake pipe" that interconnects the cars and to release the air brakes upon a pressure rise in the brake pipe. The brake pipe is pressurized by a compressor in the locomotive. When braking is desired, a brake valve in the locomotive bleeds air from the brake pipe through an orifice.

Such air brake systems may be controlled by a system referred to as communication based train control ("CBTC") or positive train control ("PTC"). In a PTC system, speed limits, temporary slow orders, movement authorities and other conditions are conveyed to a train cab using electrical signals on the rails, transponders, or wireless transmission so that aspect information can be directly displayed in the cab. An example of such a system is described in U.S. Pat. No. 5,533,695. An on-board computer scans for speed restrictions and, if a reduced speed or stop is ahead, calculates a braking distance or "braking curve" based on current speed, target speed, track gradient and train braking ability. The "target speed" and calculated "distance to target" may be displayed to the train crew. Then, the distance and time to where braking must start is calculated. In case of failure by the crew to take necessary actions such as decelerating or braking, the on-board computer can apply automated speed enforcement (i.e. penalty brake application) through an interface to the air brake system known as a "penalty valve". Such PTC systems operate under the assumption that braking control is effected only by a lead locomotive or power unit, or by multiple connected power units which are at the front of the train. To assure safe braking, such systems usually assume a conservative worst-case scenario of braking effectiveness when determining a point to initiate penalty braking.

It is also known to control braking, throttle, and other train functions remotely using distributed power control systems for locomotives (hereinafter Distributed Power or DP systems or simply DP), in which the operation of one or more remote locomotives (or group of locomotives forming a locomotive remote) is remotely controlled from the lead locomotive of the train by way of a radio or hard-wired communication system. One such radio-based DP system is commercially available under the trade name LOCOTROL, and is described in U.S. Pat. No. 4,582,280, which enables communications among locomotives when connected together to form a consist or at spaced locations along the length of train when the locomotives are spaced apart by one or more railcars.

DP systems can provide shorter braking curves because the brake pipe is being bled down by two or more brake controllers (e.g. valve orifices) and the mean path length of the brake pipe from each car to a control valve (orifice) is reduced. They can also provide improved acceleration and/or tractive force. Known DP systems such as the one described above are highly reliable, but are not generally considered "vital", i.e., their communications protocols do not conform to any specific standards for safety-critical train control operations that must be implemented in a fail-safe manner. If the communications link is interrupted performance may be downgraded.

BRIEF SUMMARY OF THE INVENTION

These and other shortcomings of the prior art are addressed by the present invention, which provides a method and apparatus for allowing power units distributed in a train to be relied on for control of train functions.

According to one aspect of the invention, a method is provided of controlling a train which includes a lead power unit, at least one remote power unit, and at least one car. The method includes: (a) using a communications channel, transmitting to the remote power unit an instruction for the remote power unit to apply at least one acceleration to the train at a future time; (b) using the remote power unit to receive the instruction; (c) using the communications channel, transmitting a confirmation that the remote power unit is armed to execute the instruction from the remote power unit to the lead power unit; and (d) computing a profile describing at least one acceleration to be applied to the train as it travels over a predetermined route. The computation is determined at least in part on whether or not the confirmation has been received by the lead power unit.

According to another aspect of the invention, a method is provided of controlling a train which includes a lead power unit, at least one remote power unit, and at least one car. The method includes: (a) computing a baseline profile describing a first set of accelerations to be applied to the train as it travels over a predetermined route; (b) computing an alternate profile describing a second set of accelerations to be applied to the train as it travels over the predetermined route; (c) transmitting the alternate profile to the remote power unit over a communications channel; (d) using the remote power unit to receive the alternate profile; (e) transmitting a confirmation that the remote power unit is armed to the alternate profile from the remote power unit to the lead power unit, over the communications channel; and (f) in the absence of the confirmation from the remote power unit, selecting baseline profile for use by the train; and (g) in the presence of the confirmation from the remote power unit, selecting the alternate profile for use by the train.

According to another aspect of the invention, a method is provided of controlling a train which includes a lead power unit, at least one remote power unit, and at least one car. The method includes: (a) computing a profile describing at least one acceleration to be applied to the train as it travels over a predetermined route; (b) transmitting the profile from the lead power unit to the remote power unit over a communications channel; (c) using the lead power unit, applying at least one acceleration to the train in accordance with the profile; (d) using the remote power unit to receive the profile; (e) transmitting a confirmation that the remote power unit is armed to the profile from the remote power unit to the lead power unit, over the communications channel; and (f) using the remote power unit, applying accelerations to the train in accordance with the profile.

According to another aspect of the invention, a control system is provided for a train including a lead power unit, at least one remote power unit, and at least one car having a braking system. The control system includes: (a) a targeted braking system operably coupled to the braking system, the targeted braking system programmed to: (i) identify a braking target located at a position ahead of the train; (ii) transmit braking target data over a communications channel; and (iii) activate the braking system at a braking point located prior to the braking target, the braking point being determined in accordance with a predetermined braking curve. The system also includes (b) a remote brake control system operably connected to the braking system, the remote brake control system programmed to: (i) receive the braking target data; (ii) transmit a confirmation to the targeted braking system over the communications channel that it is armed to the braking target; and (iii) activate the braking system at the braking point.

According to yet another aspect of the invention, a method is provided of controlling a train which includes a lead power unit carrying a targeted braking system, at least one remote power unit carrying a remote brake control system, and at least one car having a braking system operably connected to the power units. The method includes: (a) using the targeted braking system, identifying a braking target located at a position ahead of the train; (b) transmitting braking target data from the targeted braking system to the remote brake control system over a communications channel; (c) using the targeted braking system, activating the braking system at a braking point located prior to the braking target, the braking point being determined in accordance with a predetermined braking curve; (d) using the remote brake control system to receive the braking target data; (e) transmitting a confirmation that the remote brake control system is armed to the braking target from the remote brake control system to the targeted braking system, over the communications channel; and (f) using the remote brake control system, activating the braking system at the braking point.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
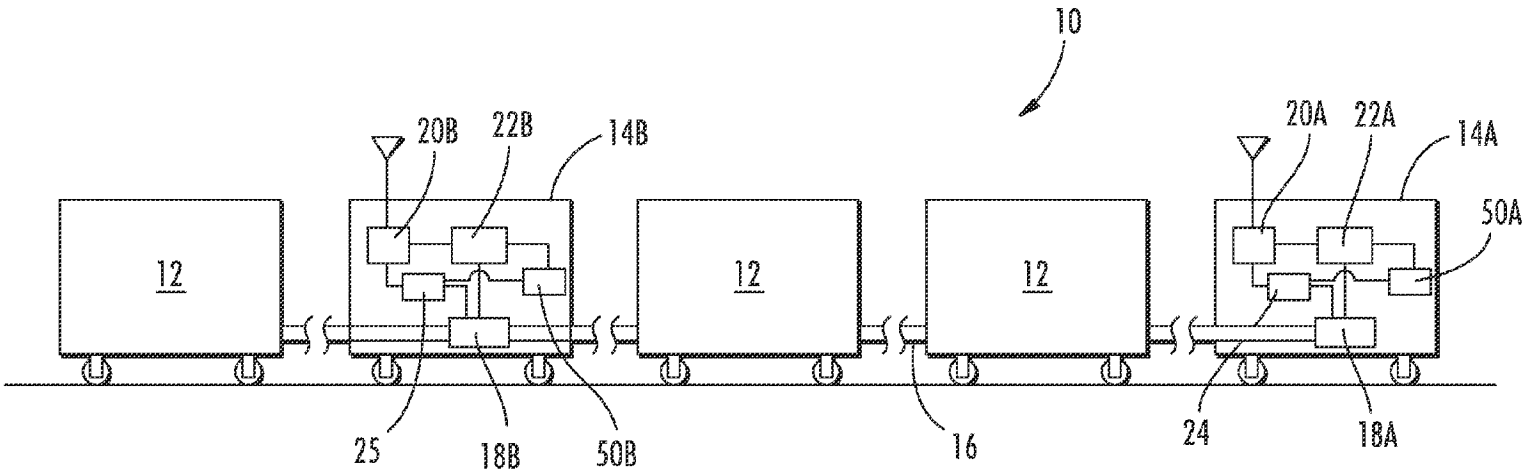
FIG. 1 is a schematic view of a train incorporating a distributed control system constructed according to an aspect of the present invention.

Referring to the drawings wherein identical reference numerals denote the same elements throughout the various views, FIG. 1 depicts a train 10 incorporating a distributed control system constructed according to an aspect of the present invention. The train 10 includes a plurality of coupled cars 12, and two or more locomotives or other units which provide tractive force, referred to herein generally as "power units" 14. The individual cars 12 are coupled together by a brake pipe 16 which conveys air pressure changes specified by individual air brake controllers 18 in the power units 14. As used herein, the term "air brake controller" refers generally to one or more components which cooperate to selectively hold or release pressure from the brake pipe 16 and may include mechanical valves, electrical, or electronic controls associated with those valves, or combinations thereof. Each of the cars 12 is provided with a known type of air brake system which functions to apply air brakes on the car 12 upon a pressure drop in the brake pipe 16 and to release the air brakes upon a pressure rise.

One of the power units 14, typically at the front of the train 10, is designated as a "lead" power unit 14A, while the remaining power units 14 are designated as "remote" power units 14B. The lead power unit 14A includes a lead radio transceiver 20A which functions to receive and transmit radio frequency (RF) communications over an intra-consist communications channel. The specific frequency band and data format is not critical. In one example, the channel is a single FM half-duplex communication channel, and the individual radio transmissions contain a serial binary code which has been FSK encoded. The lead power unit 14A also includes a lead distributed power (DP) system 22A and a targeted braking system 24, both operably connected to the lead transceiver 20A and to the lead brake controller 18A. It is noted that, in the figures, the lines shown connecting individual devices or components represent their logical or functional interconnections and need not be physical connections. For example, in some implementations these connections may take the form of messages on a data network.

The remote power unit 14B is equipped with a remote transceiver 20B, remote DP system 22B, remote brake control system 25, and remote brake controller 18B, corresponding to the similar components in the lead power unit 14A. It will be understood that the power units 14 may be identically equipped, and that any of the power units 14 may function as the lead power unit 14A or a remote power unit 14B depending upon setting of controls in the individual units. In the illustrated example, the remote brake control system 25 is a targeted braking system identical to that in the lead power unit 14A, but it will understood that a simpler unit may be used, as discussed in more detail below. Furthermore, the remote brake control system 25 could be installed on one of the unpowered railcars 12 or another vehicle in the train consist instead of one of the remote power units 14B.

Figure 2:
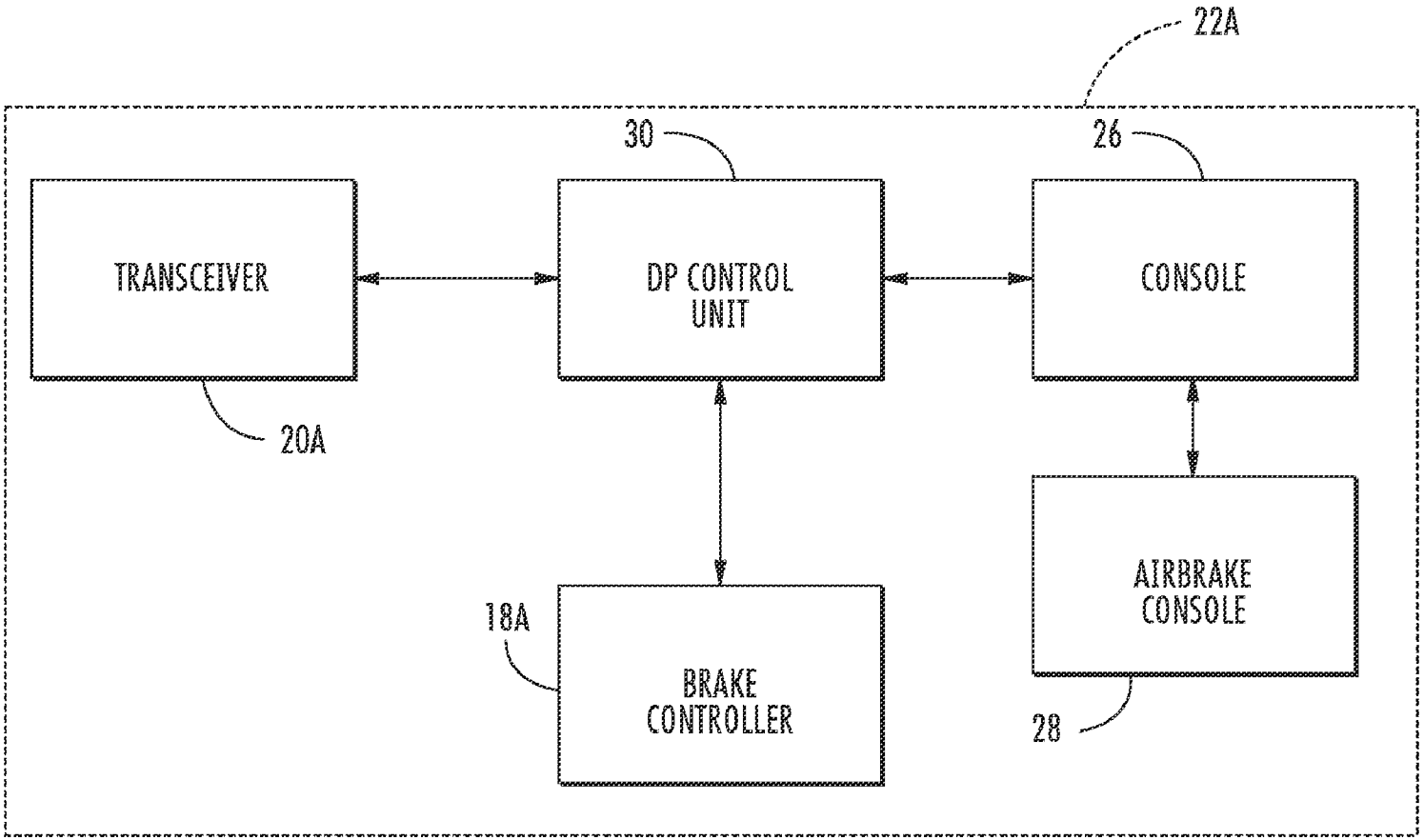
FIG. 2 is schematic view showing the components of a distributed power system.

FIG. 2 illustrates schematically the lead DP system 22A installed in the lead power unit 14A, with the understanding that it is also representative of the installation in the remote power unit 14B. It includes a console 26 which contains a plurality of controls and alarms, coupled to an air brake console 28 which contains the controls for various air brake functions. A DP control unit 30 is coupled to the console 26, the transceiver 20A, and an the airbrake controller 18A. Control inputs such as reverser position, throttle setting, and braking (ranging from fully released through full or emergency application) applied in the lead power unit 14A are encoded by the DP control unit 30 and transmitted to the transceiver 18B in the remote power unit 14B. The remote DP system 22B receives and decodes these commands and executes them in the remote power unit 14B. Using one or more remote power units 14B substantially reduces required braking distances, because there are two outflow points (i.e. brake valve orifices) and because the mean path length of the brake pipe 16 between each car and the closest outflow point is shorter than if only one brake controller 18 were used.

Figure 3:
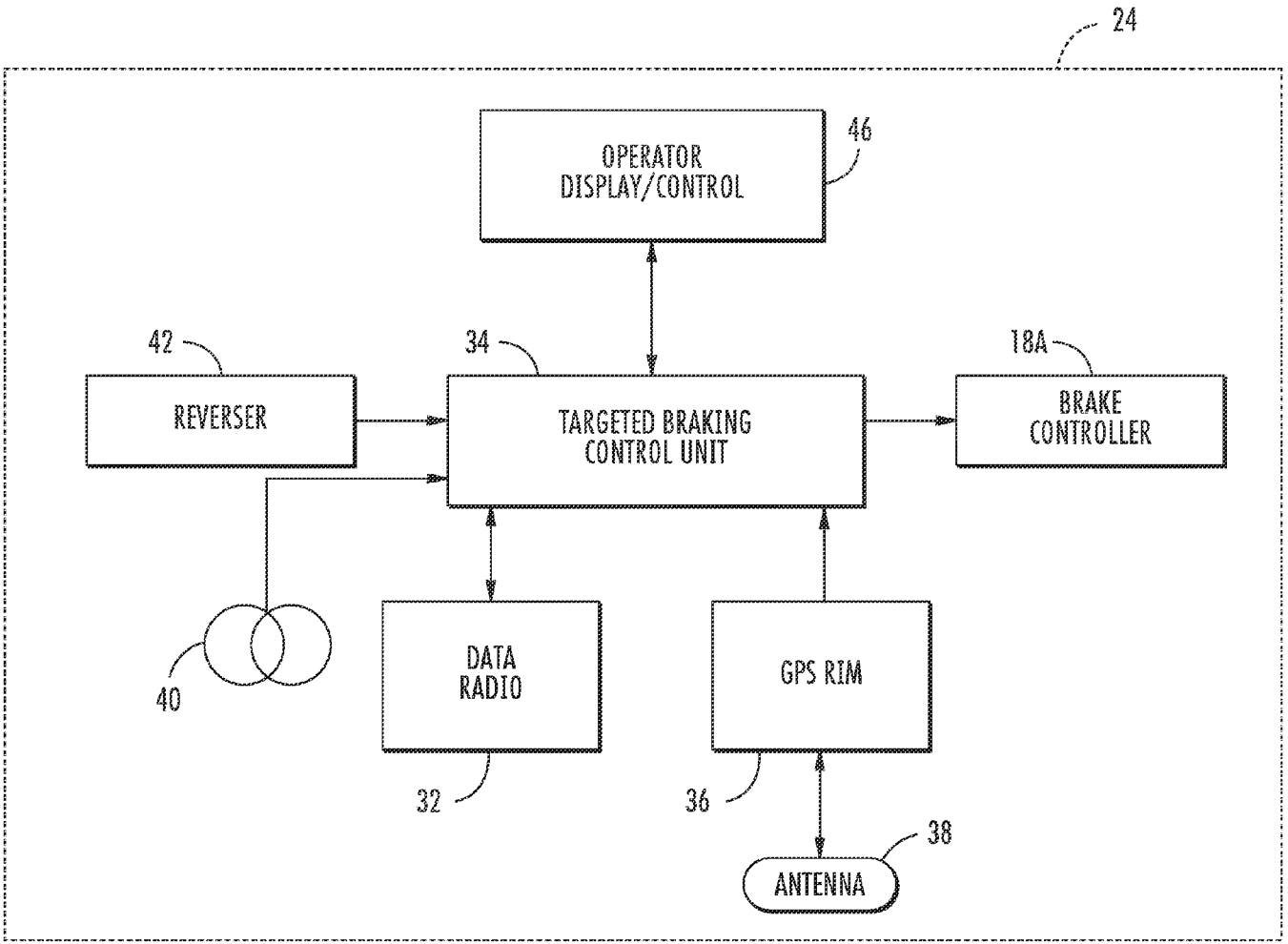
FIG. 3 is a schematic view showing the components of a PTC system.

FIG. 3 illustrates schematically the targeted braking system 24, installed in the lead power unit 14A, with the understanding that it is also representative of the installation in the remote power unit 14B. A data radio 32 is normally in a receive mode and decodes incoming profile and authority messages from wayside servers (not shown) and delivers that data to a speed monitoring and enforcement computer, referred to as targeted braking control unit 34. The hardware components of the targeted braking control unit 34 include a central processing unit (CPU), a read-only memory for program storage, a random access memory for storage of transient data derived from the input dynamic and fixed data, and interfaces to the inputs and outputs of targeted braking control unit 34 shown in FIG. 2.

A positioning unit provides a position input to the targeted braking control unit 34, so that the targeted braking control unit 34 may determine the proper train control instructions. In the illustrated example, the positioning unit is a Global Positioning System (GPS) receiver interface module (RIM) 36 connected to an antenna 38, but other devices or systems such as differential GPS, LORAN, INS, wheel tachometers, or wayside transponders could be used in lieu of or in addition to GPS to provide position information. Other inputs to the targeted braking control unit 34 include an input from a speed sensor 40 such as axle tachometers on the locomotive and an input which monitors the position of the reverser 42 in the control cab so that the targeted braking control unit 34 is made aware of the direction of movement of the train 10. Information from the speed sensor 40 is, of course, readily converted into distance traveled and speed of motion of the train 10 for use by the speed enforcement logic. For illustrative purposes, the penalty brake command is depicted as being applied through the brake controller 18A. It is noted the targeted braking system 24, or the remote brake control system 25, may be alternatively connected to the brake pipe 16 through a separate "penalty valve" (not shown).

An operator display and control unit 46 located in the cab shows the train crew data such as the "current speed" the train is traveling, the "speed limit" currently in effect, the "current milepost," the "track name," the direction of movement, a "target speed" in response to an upcoming speed restriction, a "distance to target" in feet, and a "time to penalty" designated in seconds which informs the engineer of the time remaining before a penalty brake will be applied if the train continues at its present speed. The group of components described above constituting the targeted braking system 24 are typical of what would be included in a train carrying a so-called Positive Train Control (PTC) system. Similar systems are also referred to in the industry as Automatic Train Protection (ATP) or Automatic Train Operation (ATO) systems. The key aspects of the targeted braking system 24, regardless of its specific hardware configuration, are the ability to identify a braking target, and operate the braking system of the train 10 if the specified speed conditions at the braking target are not met.

In operation, the targeted braking control unit 34 scans for speed restrictions and, if a reduction is ahead, calculates braking distance based on current speed, target speed, track gradient and train braking ability. The "target speed" and calculated "distance to target" are displayed to the train crew on the operator display 46. Then, the distance and time to where braking must start is calculated. If the remaining time is less than a predetermined limit, for example sixty seconds, "time to penalty" is displayed. If the time remaining is less than another limit, for example one second, the penalty brake is applied through interface 44. If the remaining time is greater than sixty seconds, no action is taken. The targeted braking control unit 34 also sends routine data to the operator display 46 to cause the display to show the "current speed," "speed limit," "current milepost" and other information.

Figure 4:
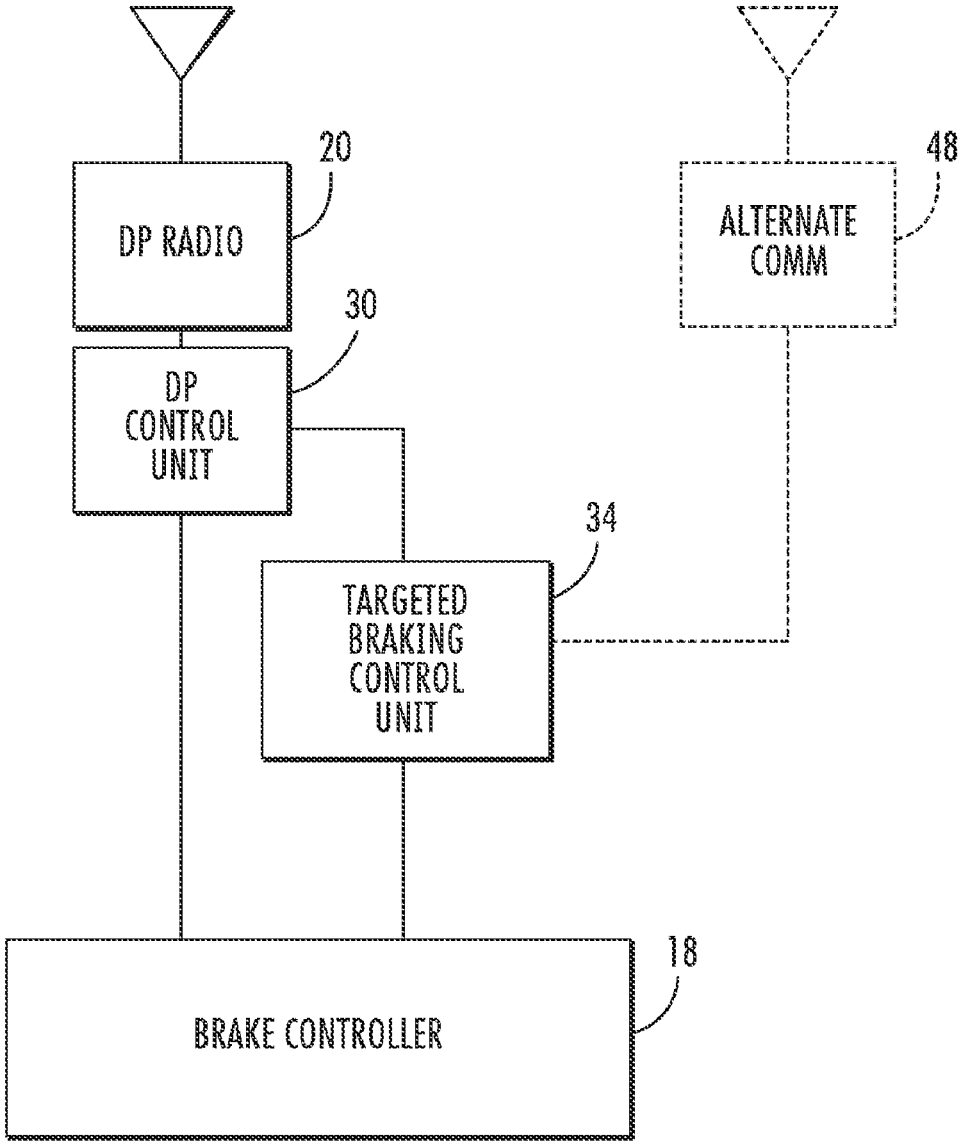
FIG. 4 is a schematic view showing the integration of DP and PTC devices in a single power unit.

FIG. 4 illustrates one possible method of integrating the targeted braking system 24 (or the remote braking unit 25) and the DP system 22. In this example, the targeted braking control unit 34 is networked to the DP transceiver 20 so that messages may be received by the DP transceiver 20 and passed to the targeted braking control unit 34, or passed from the targeted braking control unit 34 to the DP transceiver 20 and then broadcast.

Any reliable communications path may be used to transfer messages between the lead power unit 14A and remote power units 14B (i.e. to provide the intra-consist communications channel). For practical reasons, the DP transceiver 20 may be used as described above. Alternatively, the existing targeted braking data radio channel (e.g. 900 MHZ, 220 MHZ, or 50 MHZ bands) may be used. Many locomotives today are being equipped with multiple communications radios and use a communications management unit or mobile access router to select the best available path. For example, FIG. 4 illustrates an optional communications management unit 48 which has access to several different communications channels (e.g. FM, cellular, satellite) and which is operable to pass data bidirectionally between the targeted braking control unit 34 and the best available communications channel selected based on operating conditions. Wired communications could also be used for all or part of the intra-consist communications channel.

Figure 5:
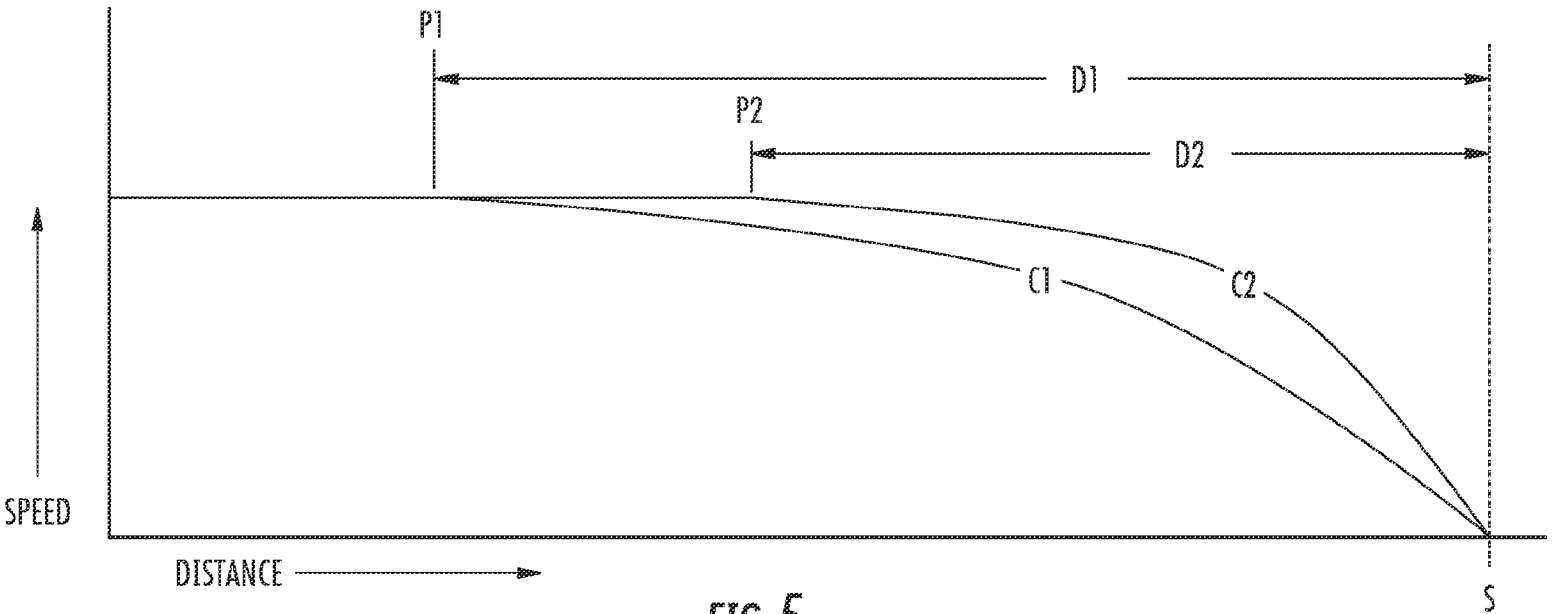
FIG. 5 is a graph illustrating an aspect of the operation of the present invention.

Referring back to FIG. 1, the distributed control system operates as follows. In an initial condition, the train 10 will operate under supervision of the targeted braking system 24 as described above, while the remote braking control unit 25 remains in a standby mode. When the targeted braking system 24 identifies a braking target ahead, such as stopping point, depicted at "S" in FIG. 5, a first plot of speed vs. distance or "braking curve", denoted "C1", is referenced to determine a brake application point "P1" which is a distance "D1" from the stopping point S. As a default condition, the targeted braking system 24 will execute a penalty brake application if a speed reduction is not made by the time the train 10 reaches point P1. The braking curve C1 is calculated based on several factors which include the configuration and mass of the train 10, speed, braking performance for the particular train type, the grade of the track, etc. It is calculated on a relatively conservative basis based on the assumption that the lead power unit 14A performs all braking without assistance from the remote power unit 14B. This may be referred to as a "long" braking curve. In addition to, or as an alternative to, a simple check of speed reduction prior to or at braking point P1, the targeted braking system 24 may also enforce the braking curve such that the train's plotted speed must remain under the curve at all times.

Next, the lead targeted braking system 24 communicates the target to the remote brake control system 25 over the intra-consist communications channel. In response, the remote brake control unit 25 switches to an active mode, and tracks the distance to target. As noted above, the remote brake control system 25 includes a positioning unit which determines the distance of the remote power unit 14B from the target (which in this case is the stopping point S). Accordingly, distance to the target calculated by the remote brake control system 25 may be reduced by the distance of the remote power unit 14B from the lead power unit 14A, in order to arrive at a more accurate distant to target. The remote brake control system 25 also "arms" itself ready to execute a penalty brake application if a speed reduction does not begin by a brake application point "P2", which is a distance "D2" from the target, which is substantially less than distance D1. The point "P2" is determined in accordance with a second braking curve "C2". The second braking curve C2, like the first braking curve C1, is calculated based on several factors which include the mass and configuration of the train, speed, braking performance for the particular train type, etc. Unlike the first or "long" braking curve C1, the second braking curve C2 is calculated on a relatively optimistic basis which presumes that the lead power unit 14A is assisted by the remote power unit 14B in applying the train brakes. This may be referred to as a "short" braking curve. In addition to, or as an alternative to, a simple check of speed reduction prior to or at the braking point P2, the remote brake control system 25 may also enforce the braking curve such that the train's plotted speed must remain under the curve at all times.

When the remote brake control system 25 is armed, it sends a confirmation message to the targeted braking unit 24 over the intra-consist communications channel. The confirmation format preferably meets reliability standards for vital train control information and may include for example, retransmissions, checksums, cyclic redundancy checks (CRCs), or other error-checking techniques. Accepted protocols for such vital train control communications are known in the art.

If the targeted braking system 24 receives satisfactory confirmation of arming from the remote brake control system 25, it will re-set itself to a condition such that it will execute a penalty brake application if a speed reduction is not made by the time the train 10 reaches point P2. This is done with the confidence that the remote brake control system 25 is also armed to the same target and braking curve and will assist in a penalty brake application. If a proper confirmation is not received, the targeted braking system 24 will continue to display to the operator and enforce operation of the train 10 assuming the default "long braking curve" performance of the train braking. In some implementations of targeted braking it may also be required that a brake pipe air pressure reduction is sensed at a certain time or position in addition to meeting the deceleration requirement of the braking curve. If the remote brake control system 25 is "armed", the sensing requirement can be delayed to match the second braking curve C2.

Presuming that the DP system remains operational, the train 10 will be operated at line speed and will begin controlled braking just before point "P2". Because of the assisted braking, it will not trigger a penalty brake application from the targeted braking system 24 or the remote brake control system 25. If conditions change so that the speed reduction or stop is no longer necessary, or a new braking target is encountered, the targeted braking system 24 will update the remote brake control system 25 to clear the braking target and/or arm the new braking target as required.

If any portion of the DP system (including the communication channel) fails and remote braking is not available, the driver will be unable to maintain a short braking distance applying brakes from the lead power unit 14A only. Under these circumstances, both the targeted braking system 24 and the remote brake control system 25 will enforce a penalty application, guaranteeing the ability to stop the train 10 in accordance with the short braking curve C2.

In addition to penalty braking, the targeted braking system 24 and remote brake controller 25 may be programmed to apply graduated, full service or emergency braking rates. When a stop or speed reduction is known to be necessary ahead of the train, braking rates may be pre-programmed into the braking control systems of each remote unit 14B and armed by data communications. If data communications are later interrupted, the pre-programmed braking rates are still guaranteed to be executed. Furthermore, by interconnection with the existing DP system, the targeted braking system and remote brake control system may be used to apply guaranteed dynamic braking of the remote power unit 14B. If conditions change so that the speed reduction or stop is no longer necessary, the remote controllers are updated by data communications.

As described in the example above, the distributed control system includes hardware of both conventional DP and targeted braking systems. However, it should be understood that a number of different architectures are possible to achieve the results described herein. Conceptually, the only hardware requirements for each remote power unit 14A (in addition to the DP hardware, if used) are: (1) a control unit capable of receiving, storing, and executing braking commands from the lead targeted braking system 24; (2) a brake controller operably connected to the control unit; and (3) means for determining the absolute or relative position of the remote power unit 14B, or the distance traveled by the remote power unit 14B, and reporting that position or distance information to the control unit. Under some circumstances it may be desirable to incorporate some or all of these functions into an existing DP system rather than installing a full targeted braking system. If the remote brake control system 25 is not a targeted braking system, information in addition to the braking target, such as grade and/or upcoming grade information, or distance until braking point information, may be transmitted from the targeted braking system to the remote brake control system 25. Brake application by the remote brake control system 25 may then be based on a criteria such as distance traveled rather than position.

In addition to, or as an alternative to, the distributed power and targeted braking systems described above, the train 10 may incorporate an optimizer. The optimizer is referred to generally by the numeral 50 and is shown in FIG. 1 configured as a lead optimizer 50A operably connected to the lead DP system 22A and the targeted braking system 24 in the lead power unit 50, for example through a data network. A similar remote optimizer 50B is shown operably connected to the remote DP system 22B and the remote brake control unit 25 in the remote power unit 14B. It is noted that the optimizer 50 need not require any special hardware, but could instead be embodied as software running on the DP system 22, the targeted braking system 24, or any other processor carried on board the train 10.

The optimizer 50 accepts input information specific to planning a trip either on board or from a remote location, such as a dispatch center (not shown). Such input information may include, but is not limited to, train position, consist description (such as power unit models), power unit description, performance of power unit traction transmission, consumption of engine fuel as a function of output power, cooling characteristics, the intended trip route (effective track grade and curvature as function of milepost or an "effective grade" component to reflect curvature following standard railroad practices), the train 10 represented by car makeup and loading together with effective drag coefficients, trip desired parameters including, but not limited to, start time and location, end location, desired travel time, crew (user and/or operator) identification, crew shift expiration time, and route.

This data may be provided to the optimizer 50 in a number of ways, such as, but not limited to, an operator manually entering this data via the control and display unit 46 of the targeted braking system (see FIG. 3), inserting a memory device such as a hard card and/or USB drive containing the data into a receptacle aboard the power unit 14, and transmitting the information via wireless communication from a central or wayside location, such as a track signaling device and/or a wayside device, to the optimizer 50. Power unit and train load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in power unit or train characteristics detected by monitoring equipment on or off board the power unit(s) 14.

The optimizer 50 uses the input information in accordance with a selected optimization goal to compute a trip plan or "profile" which is calculated to achieve the selected goal subject to speed limit constraints along the route with desired start and end times. The profile contains the speed and power (notch) settings the train is to follow, expressed as a function of distance and/or time, and such train operating limits, including but not limited to, the maximum notch power and brake settings, and speed limits as a function of location, and the expected fuel used and emissions generated. In a broader sense, the profile provides power settings for the train 10, either at the train level, consist level and/or power unit level. As used with reference to the profile, the term "power" may be understood to include tractive effort, dynamic braking, locomotive brakes, and/or train brakes (airbrakes).

The goal may be set up flexibly, for example to minimize fuel consumption subject to constraints on emissions and speed limits, to minimize emissions, subject to constraints on fuel use and arrival time, to minimize wheel-on-rail lateral forces, or to minimize in-train longitudinal buff and draught forces. It is also possible to set up, for example, a goal to minimize the total travel time without constraints on total emissions or fuel use where such relaxation of constraints would be permitted or required for the mission. This might occur, for example, when it is desired to have the train 10 enter a siding, vacating a main line, as quickly as possible to avoid delaying another train that needs to occupy the main line.

The optimizer 50 implements the profile by prompting the train driver to make throttle and brake applications, or by automatically generating instructions for throttle, dynamic brake, and/or train brakes (for example through connections to the targeted braking system 24, and/or the DP system 22), or by a combination of prompting and automated control. In its most general sense, the optimizer 50 determines a set or series of accelerations to apply to the train 10. The term "acceleration" is used here in the general sense meaning "a change in velocity" which encompasses increases and decreases in speed, as well as changes of direction.

The train 10 with the optimizer 50 may be operated, using the distributed control confirmation principles described above, as follows. Initially, a baseline profile is computed using the input information described above. The baseline profile is computed on a relatively conservative set of operational characteristics, assuming that the lead power unit 14A provides all tractive effort and all dynamic and locomotive braking, and train brake applications, without assistance from the remote power unit 14B. In essence, the baseline profile uses a first set of acceleration capabilities.

Next, an alternate profile is computed and communicated to the remote optimizer 50B, for example by being transmitted by the lead optimizer 50A over the intra-consist communications channel. In response, the remote optimizer 50B "arms" itself ready to execute train control commands in accordance with an alternate profile. The alternate profile, like the baseline profile, is calculated based on the input information described above. However, unlike the baseline profile, the alternate profile is calculated on a relatively optimistic basis which presumes that the lead power unit 14A is assisted by the remote power unit 14B in providing tractive effort and/or applying brakes (e.g. locomotive, dynamic, and/or train brakes (airbrakes)). In other words, the computation of the alternate profile takes into account the status of at least one distributed control function. The alternate profile may use a second set of acceleration capabilities which is substantially better than the first set of acceleration capabilities in at least one aspect.

When the remote optimizer 50 is armed, it sends a confirmation message to the lead optimizer 50 over the intra-consist communications channel. The confirmation format preferably meets reliability standards for vital train control information and may include for example, retransmissions, checksums, cyclic redundancy checks (CRCs), or other error-checking techniques. Accepted protocols for such vital train control communications are known in the art.

If the lead optimizer 50 receives satisfactory confirmation of arming from the optimizer, it will re-set itself to a condition such that it will follow the alternate profile in controlling the train 10 and/or prompting the operator. This is done with the confidence that the remote optimizer 50 is also armed to the alternate profile and will assist in train control. If a proper confirmation is not received, the lead optimizer 50 will continue to control the train 10 and/or prompt the operator with the relatively reduced train performance associated with the baseline profile.

Presuming that the DP system 22 or other interface of the lead and remote power units 14A and 14B remains operational, the train 10 may be operated in accordance with the alternate profile using real-time commands and will experience enhanced performance capabilities (e.g. acceleration and deceleration) relative to a train controlled solely from a front-end consist. The enhanced performance can be put to good use by running trains closer together (tighter spacing) and can increase the throughput of trains on a given section of track.

If any portion of the DP system or other interface between the lead and remote power units 14A and 14B (including the communication channel) fails and real-time remote control is not available, the driver or lead optimizer 50A will be unable to maintain the alternate profile from the lead power unit 14A only. Under these circumstances, both the lead optimizer 50A and the remote optimizer 50B will independently control the previously armed and confirmed alternate profile, guaranteeing the ability to control acceleration and braking of the train 10 in accordance with the alternate profile.

The foregoing has described a distributed control system and method for a train. The method allows for a train operation supervision system such as Positive Train Control (PTC) to operate trains closer to obstacles (signals or other trains) by using a shorter guaranteed braking curve than if distributed brake applications are not considered. The method enables shorter braking curves in a safety critical way, at less cost and greater reliability than with electro-pneumatic controlled (ECP) braking methods. While specific embodiments of the present invention have been described, it will be apparent to those skilled in the art that various modifications thereto can be made without departing from the spirit and scope of the invention. Some examples of other applications for the above-describe distributed control system include, but are not limited to: (1) Specialized rail applications where control of the train is from a central location rather than the lead locomotive, i.e. communications may be from a base to each locomotive individually rather than through intra-consist radios; (2) The use of an automatic train operation system with or without a driver or control console onboard; and (3) application to ECP braking systems in lieu of air brake pipe controlled systems (i.e. if the wired or wireless braking link along the train is broken, the system described herein can provide a backup path to the "isolated" part of the train 10 to permit a contingency operation). Accordingly, the foregoing description of the preferred embodiment of the invention and the best mode for practicing the invention are provided for the purpose of illustration only and not for the purpose of limitation, the invention being defined by the claims.

What is claimed is:

1. A method of controlling a train which includes a lead power unit, at least one remote power unit, and at least one car, the method comprising:

(a) using a communications channel, transmitting to the remote power unit an instruction for the remote power unit to apply at least one acceleration to the train at a future time;

(b) using the remote power unit to receive the instruction;

(c) using the communications channel, transmitting a confirmation that the remote power unit is armed to execute the instruction from the remote power unit to the lead power unit; and (d) computing a profile describing at least one acceleration to be applied to the train as it travels over a predetermined route, wherein the computation is determined at least in part on whether or not the confirmation has been received by the lead power unit.

2. The method of claim 1, further comprising:

(e) in the absence of the confirmation from the remote power unit, computing a baseline profile for use by the train; and (f) in the presence of the confirmation from the remote power unit, computing an alternate profile for use by the train.

3. The method of claim 2 wherein the baseline profile is computed using a first set of acceleration capabilities of the train, and the alternate profile is computed using a second set of acceleration capabilities of the train, wherein the second set of acceleration capabilities is substantially better than the first set of acceleration capabilities in at least one aspect.

4. The method of claim 3 wherein the first and second sets of acceleration capabilities take into account at least one of tractive effort, dynamic braking, and braking.

5. The method of claim 1 further comprising prompting an operator to apply at least one acceleration to the train in accordance with the computed profile.

6. The method of claim 1 further comprising using at least one of the lead power unit and the remote power unit to apply at least one acceleration to the train in accordance with the computed profile.

7. A method of controlling a train which includes a lead power unit, at least one remote power unit, and at least one car, the method comprising:

(a) computing a baseline profile describing a first set of accelerations to be applied to the train as it travels over a predetermined route;

(b) computing an alternate profile describing a second set of accelerations to be applied to the train as it travels over the predetermined route;

(c) transmitting the alternate profile to the remote power unit over a communications channel;

(d) using the remote power unit to receive the alternate profile;

(e) transmitting a confirmation that the remote power unit is armed to the alternate profile from the remote power unit to the lead power unit, over the communications channel; and (f) in the absence of the confirmation from the remote power unit, selecting baseline profile for use by the train; and (g) in the presence of the confirmation from the remote power unit, selecting the alternate profile for use by the train.

8. The method of claim 7 wherein the baseline profile is computed using a first set of acceleration capabilities of the train, and the alternate profile is computed using a second set of acceleration capabilities of the train, wherein the second set of acceleration capabilities is substantially better than the first set of acceleration capabilities in at least one aspect.

9. The method of claim 8 wherein the first and second sets of acceleration capabilities take into account at least one of tractive effort, dynamic braking, and braking.

10. The method of claim 7 further comprising prompting an operator to apply at least one acceleration to the train in accordance with the selected profile.

11. The method of claim 7 further comprising using at least one of the lead power unit and the remote power unit to apply at least one acceleration to the train in accordance with the selected profile.

12. A method of controlling a train which includes a lead power unit, at least one remote power unit, and at least one car, the method comprising:

(a) computing a profile describing at least one acceleration to be applied to the train as it travels over a predetermined route;

(b) transmitting the profile from the lead power unit to the remote power unit over a communications channel;

(c) using the lead power unit, applying at least one acceleration to the train in accordance with the profile;

(d) using the remote power unit to receive the profile;

(e) transmitting a confirmation that the remote power unit is armed to the profile from the remote power unit to the lead power unit, over the communications channel; and (f) using the remote power unit, applying accelerations to the train in accordance with the profile.

13. The method of claim 12, wherein step (c) further comprises:

(a) in the absence of the confirmation from the remote power unit, using the lead power unit to apply accelerations to the train in accordance with a baseline profile; and (b) in the presence of the confirmation from the remote power unit, using the lead power unit to apply accelerations to the train in accordance with an alternate profile.

14. The method of claim 12 wherein the alternate profile is computed assuming substantially better acceleration capabilities of the train than the baseline profile.

15. The method of claim 13, further comprising using the remote power unit to apply accelerations to the train in accordance with the alternate profile.

16. The method of claim 12 wherein at least one acceleration is applied to the train through tractive effort of at least one of the lead power unit and the remote power unit.

17. The method of claim 12 wherein at least one acceleration is applied to the train through dynamic braking of at least one of the lead power unit and the remote power unit.

18. The method of claim 12 wherein at least one acceleration is applied to the train through braking of at least one of the lead power unit, the remote power unit, and the at least one car.

19. The method of claim 12 wherein the profile is computed to optimize fuel consumed.

20. The method of claim 12 wherein the profile is computed to optimize emissions.

21. The method of claim 12 wherein the profile is computed to optimize trip time between predefined start and end points.

22. The method of claim 12 wherein the profile is computed to minimize wheel-on-rail lateral forces.

23. The method of claim 12 wherein the profile is computed to minimize in-train longitudinal buff and draught forces.

24. A control system for a train including a lead power unit, at least one remote power unit, and at least one car having a braking system, the control system comprising:

(a) a targeted braking system operably coupled to the braking system, the lead targeted braking system programmed to:

(i) identify a braking target located at a position ahead of the train;

(ii) transmit braking target data over a communications channel; and (iii) activate the braking system at a braking point located prior to the braking target, the braking point being determined in accordance with a predetermined braking curve; and (b) a remote brake control system operably connected to the braking system, the remote brake control system programmed to:

(i) receive the braking target data;

(ii) transmit a confirmation to the targeted braking system over the communications channel that it is armed to the braking target; and (iii) activate the braking system at the braking point.

25. The control system of claim 24, wherein the targeted braking unit is programmed to:

(a) in the absence of the confirmation from the remote brake control system, activate the braking system at a first braking point determined in accordance with a first braking curve; and (b) in the presence of the confirmation from the remote brake control system, activate the braking system at a second braking point determined in accordance with a second braking curve.

26. The control system of claim 25 wherein the second braking point is substantially closer to the braking target than the first braking point.

27. The control system of claim 25, wherein the remote brake control system is programmed to activate the braking system at the second braking point.

28. The control system of claim 24 wherein each of the targeted braking system and the remote brake control unit includes a respective positioning unit adapted to provide location information thereto.

29. The control system of claim 24 further comprising:

a lead distributed power (DP) system operably connected to the braking system, the lead DP system adapted to transmit braking commands over the communications channel; and a remote DP system including a DP control unit operably connected to the braking system and adapted to activate the braking system in response to the braking commands received from the lead DP system.

30. The control system of claim 29 wherein the lead DP system is carried in the lead power unit and the remote DP system is carried in the remote power unit.

31. The control system of claim 24 wherein the targeted braking system and remote brake control system are programmed to activate the braking system only if a predetermined speed condition is not met.

32. The control system of claim 24 wherein the targeted braking system is carried in the lead power unit and the remote brake control system is carried in the remote power unit.

33. The control system of claim 24 wherein the braking system is an air brake system.

34. The control system of claim 24 wherein the braking system is a dynamic braking system.

35. The control system of claim 24 wherein the communications channel is an RF channel.

36. A method of controlling a train which includes a lead power unit carrying a targeted braking system, at least one remote power unit carrying a remote brake control system, and at least one car having a braking system operably connected to the power units, the method comprising:

(a) using the targeted braking system, identifying a braking target located at a position ahead of the train;

(b) transmitting braking target data from the targeted braking system to the remote brake control system over a communications channel;

(c) using the targeted braking system, activating the braking system at a braking point located prior to the braking target, the braking point being determined in accordance with a predetermined braking curve;

(d) using the remote brake control system to receive the braking target data;

(e) transmitting a confirmation that the remote brake control system is armed to the braking target from the remote brake control system to the targeted braking system, over the communications channel; and (f) using the remote brake control system, activating the braking system at the braking point.

37. The method of claim 36, wherein step (c) further comprises:

(a) in the absence of the confirmation from the remote brake control system, using the targeted braking system to activate the braking system at a first braking point determined in accordance with a first braking curve; and (b) in the presence of the confirmation from the remote system, using the targeted braking system to activate the braking system at a second braking point determined in accordance with a second braking curve.

38. The method of claim 37 wherein the second braking point is substantially closer to the braking target than the first braking point.

39. The method of claim 38, further comprising using the remote brake control unit to activate the braking system at the second braking point.

40. The method of claim 36 wherein each of the targeted braking system and the remote brake control unit includes a respective positioning unit which provides location information thereto.

41. The method of claim 36 further comprising:

(a) using a lead distributed power (DP) system including a lead DP control unit operably connected to braking system to transmit braking commands over the communications channel; and (b) using a remote DP system including a remote DP control unit operably connected to the braking system to activate the braking system in response to the braking commands received from the lead DP system.

42. The method of claim 41 wherein the lead DP system is carried in the lead power unit and the remote DP system is carried in the remote power unit.

43. The method of claim 36 wherein the targeted braking system and remote brake control system activate the braking system only if a predetermined speed condition is not met.

44. The method of claim 36 wherein the braking system is an air brake system.

45. The method of claim 36 wherein the communications channel is an RF channel.

* * * * *

UNITED STATES PATENT AND TRADEMARK OFFICE

CERTIFICATE OF CORRECTION

PATENT NO. : 7,395,141 B1
APPLICATION NO. : 11/854425
DATED : July 1, 2008
INVENTOR(S) : Daryl William Seck et al.

It is certified that error appears in the above-identified patent and that said Letters Patent is hereby corrected as shown below:

Claim 7, line 19, insert -- the -- before “baseline”.

Claim 24, line 5, delete “lead”.

Claim 25, line 2, change “unit” to -- system --.

Claim 28, line 2, change “unit” to -- system --.

Claim 39, line 2, change “unit” to -- system --.

Claim 40, line 2, change “unit” to -- system --.

Signed and Sealed this

Thirtieth Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,395,141 B1
APPLICATION NO. : 11/854425
DATED : July 1, 2008
INVENTOR(S) : Daryl William Seck et al.

It is certified that error appears in the above-identified patent and that said Letters Patent is hereby corrected as shown below:

Column 11, Claim 7, line 51, insert -- the -- before "baseline".

Column 12, Claim 24, line 62, delete "lead".

Column 13, Claim 25, line 14, change "unit" to -- system --.

Column 13, Claim 28, line 30, change "unit" to -- system --.

Column 14, Claim 39, line 35, change "unit" to -- system --.

Column 14, Claim 40, line 38, change "unit" to -- system --.

This certificate supersedes the Certificate of Correction issued September 30, 2008.

Signed and Sealed this

Twenty-first Day of October, 2008

JON W. DUDAS
*Director of the United States Patent and Trademark Office*